US006908022B2

(12) United States Patent
Schmitz

(10) Patent No.: US 6,908,022 B2
(45) Date of Patent: Jun. 21, 2005

(54) WASHER FEEDING AND POSITIONING ATTACHMENT FOR FASTENER DRIVER

(76) Inventor: Jeffrey F. Schmitz, 3 Pine Ridge Rd., Asheville, NC (US) 28804

( * ) Notice: Subject to any disclaimer, the term of this patent is extended or adjusted under 35 U.S.C. 154(b) by 431 days.

(21) Appl. No.: 09/759,411

(22) Filed: Jan. 12, 2001

(65) Prior Publication Data

US 2001/0054635 A1 Dec. 27, 2001

Related U.S. Application Data

(60) Provisional application No. 60/175,887, filed on Jan. 13, 2000.

(51) Int. Cl.[7] ..... B25C 7/00
(52) U.S. Cl. ..... 227/119; 227/15; 227/18
(58) Field of Search ..... 227/15, 18, 119

(56) References Cited

U.S. PATENT DOCUMENTS

| | | | | | |
|---|---|---|---|---|---|
| 2,886,815 | A | * | 5/1959 | Young | 227/120 |
| 3,228,555 | A | * | 1/1966 | Pinto | 221/199 |
| 3,595,460 | A | * | 7/1971 | Pitkin | 227/112 |
| 3,734,377 | A | | 5/1973 | Munn | |
| 4,033,499 | A | | 7/1977 | Butler | |
| 4,339,065 | A | | 7/1982 | Haytayan | |
| 4,657,167 | A | | 4/1987 | Mays | |
| 5,014,876 | A | * | 5/1991 | Young et al. | 221/233 |
| 5,056,684 | A | * | 10/1991 | Beach et al. | 221/186 |
| 5,105,980 | A | | 4/1992 | Hofmann | |
| 5,163,580 | A | * | 11/1992 | Beach et al. | 206/445 |
| 5,484,094 | A | | 1/1996 | Gupta | |
| 5,634,583 | A | | 6/1997 | McGuinness et al. | |
| 5,791,546 | A | | 8/1998 | McGuinness et al. | |
| 5,813,114 | A | * | 9/1998 | Blacket et al. | 227/119 |
| 5,865,341 | A | * | 2/1999 | Martin | 221/197 |
| 5,947,362 | A | | 9/1999 | Omli | |
| 6,065,660 | A | | 5/2000 | Cabrera | |
| 6,070,758 | A | * | 6/2000 | Graham | 221/183 |
| 6,082,577 | A | * | 7/2000 | Coates et al. | 221/80 |
| 6,112,944 | A | * | 9/2000 | Van Hoorn et al. | 221/190 |
| 6,273,316 | B1 | * | 8/2001 | Losada | 227/119 |
| 6,302,310 | B1 | * | 10/2001 | Lamb | 221/232 |

* cited by examiner

*Primary Examiner*—Rinaldi I. Rada
*Assistant Examiner*—Michelle Lopez
(74) *Attorney, Agent, or Firm*—Carter Schnedler & Monteith, P.A.

(57) ABSTRACT

A pneumatically operated washer feeding attachment for use with a fastener driver of the type having a driver stroke axis and an exit barrel. A delivery channel has an acceleration chamber at one end for receiving washers one at a time from a magazine, and a retention region at the other end to which washers are pneumatically driven. The retention region has an exit aperture aligned with the fastener driver exit barrel and with the exit aperture. The attachment is powered by collected exhaust gas from the fastener driver. Some embodiments require no moving parts.

17 Claims, 9 Drawing Sheets

WASHER FEEDING AND POSITIONING ATTACHMENT FOR FASTENER DRIVER

CROSS-REFERENCE TO PROVISIONAL PATENT APPLICATION

The benefit of U.S. provisional patent application Ser. No. 60/175,887, filed Jan. 13, 2000, is claimed.

BACKGROUND OF THE INVENTION

Nails fitted with plastic or metal load dispersion and sealing washers are typically employed in applications such as attaching roof underlayment, tar paper, metal lath, foam board, and vapor barrier, as examples. Nails fitted with washers are not well suited for feeding from a nail magazine into a power operated fastener driver. Accordingly, and even though power operated fastener drivers are commonly used in modern construction methods, nails fitted with washers are typically hand driven, with a hammer.

SUMMARY OF THE INVENTION

It is therefore seen to be desirable to provide a washer feeding attachment which is readily adaptable to commonly employed power operated fastener drivers, especially pneumatically powered fastener drivers, for individually positioning washers for engagement by fasteners driven by the fastener driver. The washer is thus assembled onto the fastener as the fastener is driven by the fastener driver, resulting in proper washer and fastener installation into the work surface with which the fastener driver is in contact. It is further seen to be desirable to provide such an attachment that is non-encumbering, space-efficient, reliable, easy to use, low maintenance and cost efficient. Beyond the primary consideration of a fully functioning attachment which employs washers similar to or of the kind already manufactured for fitting in advance to nails, it is desirable to facilitate packaging and reloading of the washers. It is also desirable to provide for simple mounting to a variety of existing pneumatic fastener driver tools. In addition, it is desirable to employ the existing exhaust from the pneumatic fastener driver for powering the attachment.

Embodiments of the invention are attached to fastener drivers of the type having a driver stroke axis and an exit barrel. In an exemplary embodiment of the invention, washer feeding apparatus includes a magazine for holding a plurality of washers. A delivery channel has an acceleration chamber at one end for receiving washers one at a time from the magazine, and a retention region at the other end to which washers are pneumatically driven. The retention region has an exit aperture aligned with the exit barrel and arranged such that a washer retained in the retention region is in alignment with the fastener driver exit barrel and with the exit aperture. A supply of pressurized gas propels washers from the acceleration chamber to the retention region for subsequent engagement by fasteners driven by the fastener driver. The washers then exit from the retention region through the exit aperture.

The invention advantageously may be embodied in a feeding attachment which contains no moving parts.

DETAILED DESCRIPTION

Figure 1:
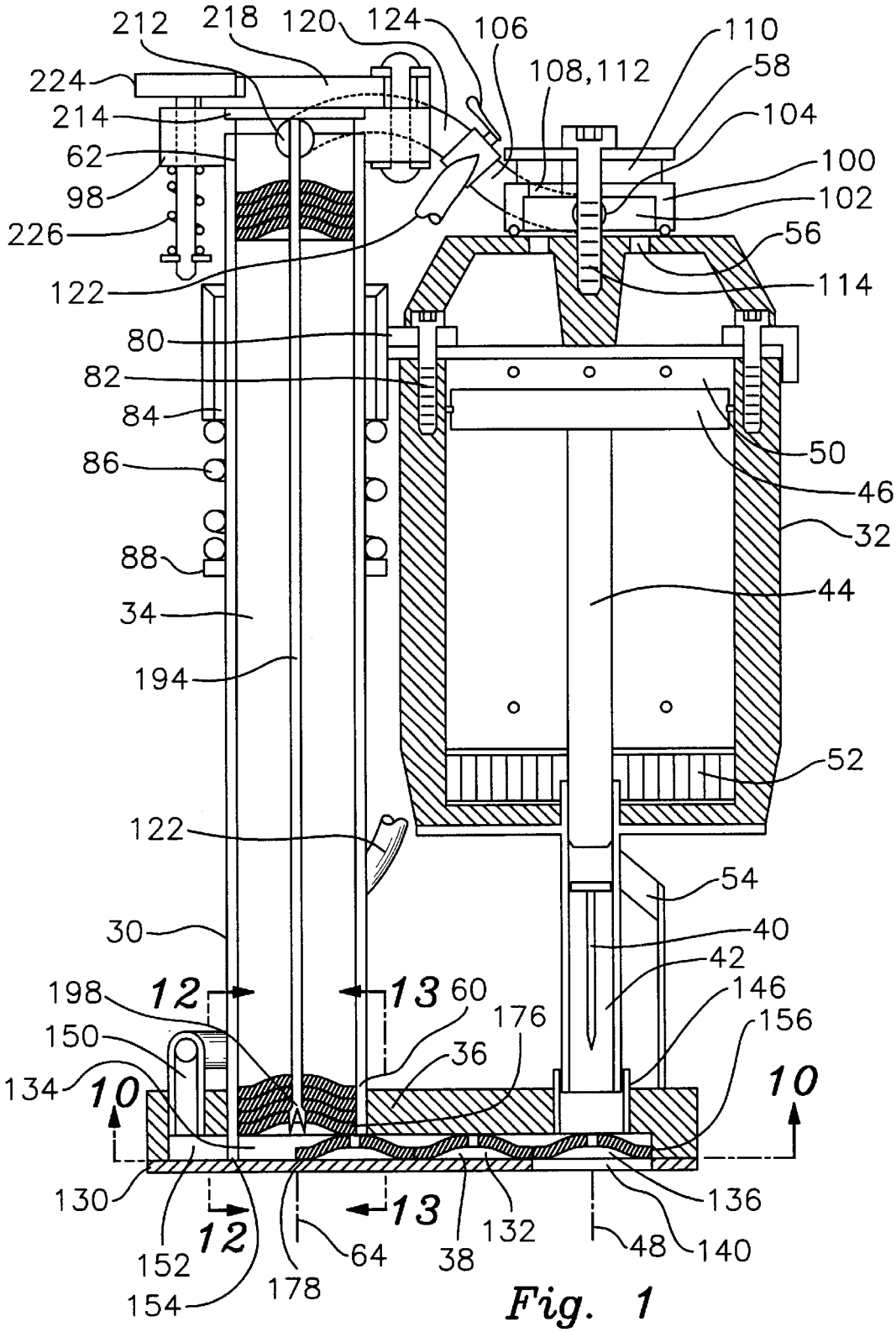
FIG. 1 is a side view, partially sectioned, of a washer feeding apparatus embodying the invention assembled to a fastener driver.
Figure 2:
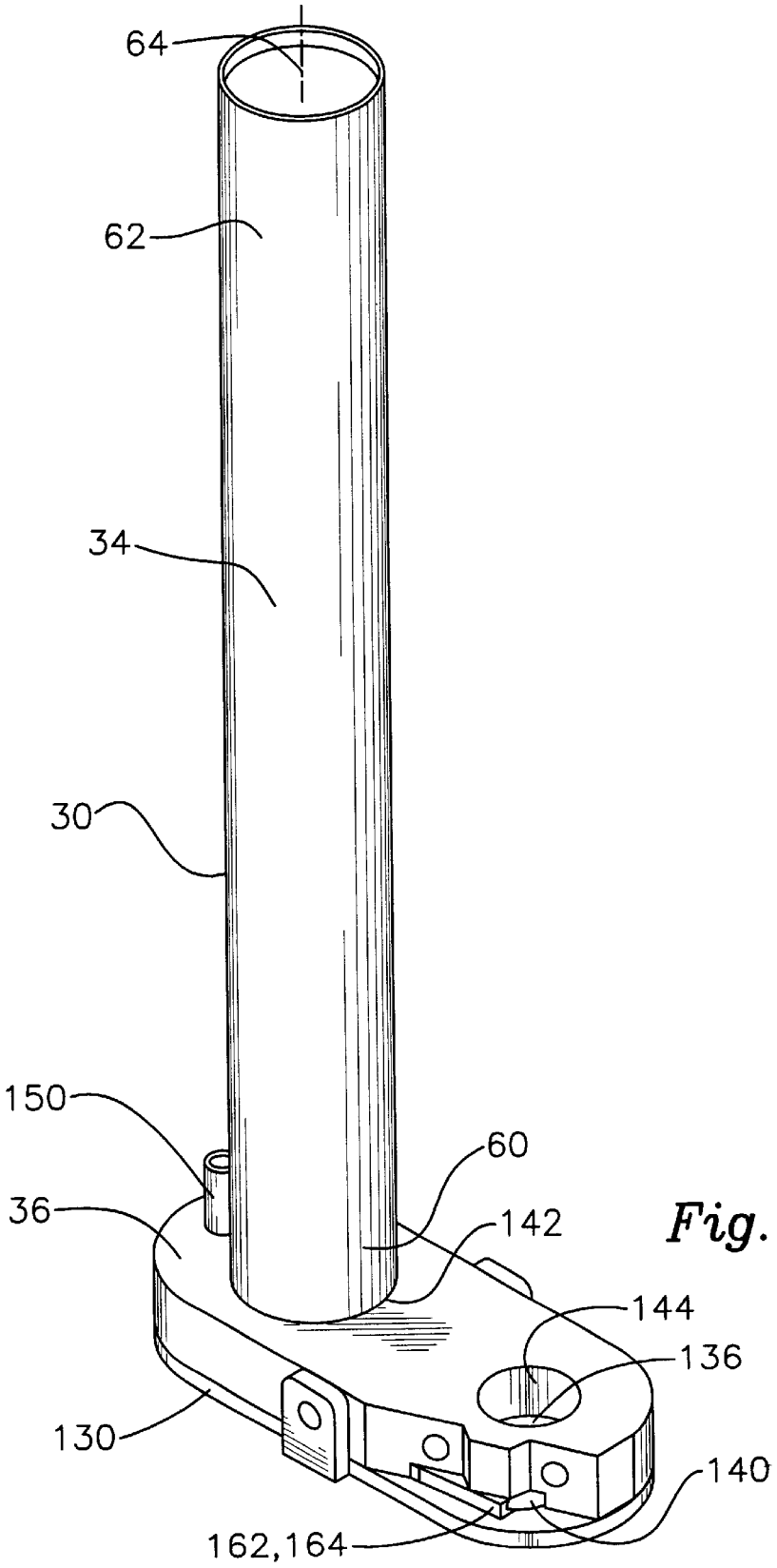
FIG. 2 is a three dimensional view of the tubular magazine and channel housing of the washer feeding apparatus of FIG. 1.

Referring first to FIGS. 1 and 2, FIG. 1 depicts a washer feeding apparatus 30 embodying the invention assembled to a fastener driver 32, in the exemplary form of a pneumatically operated nail gun 32. The washer feeding apparatus 30 in overview comprises a magazine 34 for holding a plurality of washers, as well as a channel housing 36, which are shown in the three-dimensional view of FIG. 2. Plastic washers 38 (also known as fastener caps 38) are shown, but the apparatus 30 may be employed to feed and position metal washers as well, with or without a pre-formed central aperture. The apparatus 30 can also be used with washers that are stapled.

The fastener driver 32 of FIG. 1 is representative of any one of a variety of commercially available fastener drivers, and for purposes of example is a pneumatically operated nail gun 32 for driving fasteners such as a representative roofing nail 40. Briefly, the pneumatic fastener driver 32 includes an exit barrel 42 from which fasteners, such as the representative roofing nail 40, are driven by a hammer 44 connected to a piston 46. The hammer 44 and piston 46 reciprocate on a driver stroke axis 48. The pneumatically operated nail gun 32 is connected to a source of compressed air (not shown). Valving and porting (not shown) within the nail gun 32 direct compressed air to a chamber 50 above the piston 46 when a nail is to be driven, driving the piston 46 downwardly to a resilient rebound element 52. The pneumatic fastener driver 32 includes a trigger (not shown), as well as a contact safety mechanism represented by a linkage 54 which is connected to a trigger mechanism (not shown) and which prevents the fastener driver 32 from operating unless it is pressed against a work surface, such as a roof, to be nailed. As part of the fastener driver 32 operation cycle, in particular, as the piston 46 and 44 return to the upper position shown in FIG. 1, compressed air exits the fastener driver 32 through a plurality of exhaust gas ports 56.

The pneumatic fastener driver 32 of FIG. 1 has been slightly modified by removing the shoe (not shown) associated with the contact safety mechanism linkage 54, which is instead connected to the channel housing 36 of the washer feeding apparatus 30 embodying the invention, thereby saving space by integrating the contact safety mechanism with the washer feeding apparatus 30. In addition, the top of the pneumatic fastener driver 32 is fitted with an exhaust collection system generally designated 58. The exhaust collection system 58 replaces the original exhaust gas manifold (not shown) of the pneumatic fastener driver 32, and captures at least a portion of the exhaust gas exiting the exhaust ports 56 for operating the washer feeding apparatus 30. Constructional details of the exhaust collection system 58 are described hereinbelow with reference to FIGS. 4–6.

In the illustrated embodiment, the magazine 34 for holding a plurality of washers 38 is a tubular magazine 34. The tubular magazine 34 has two ends 60 and 62. The end 60 is fixed to the channel housing 36, and may also be referred to as the lower or exit end 60 of the magazine 34. The other end 62 of the tubular magazine 34 may also be referred to as the upper or filling end 62.

The tubular magazine 34 has a central axis 64, and is mounted such that the magazine axis 64 is at least approximately parallel to the driver stroke axis 48.

Figure 3:
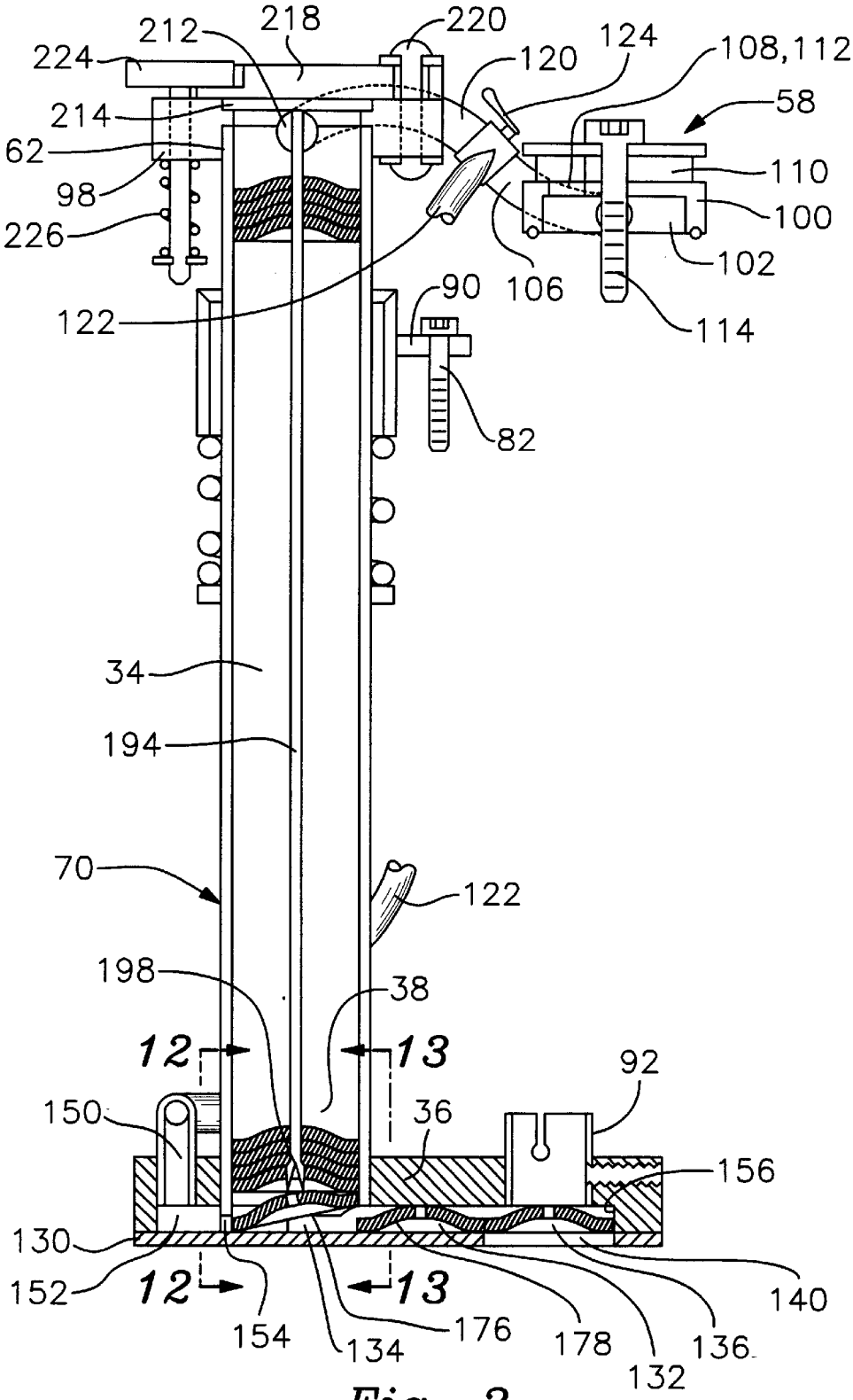
FIG. 3 is a side view, partially sectioned, of another washer feeding apparatus embodying the invention, shown in isolation.

In the embodiment of FIG. 1, the tubular magazine 34 and channel housing 36 are mounted for axial movement relative to the fastener driver 32, and this axial movement is integrated with the contact safety mechanism linkage 54. FIG. 3, described hereinbelow, depicts an alternative embodiment of a washer feeding apparatus 70, in which the tubular magazine 34 and the channel housing 36 are rigidly attached to the fastener driver 32.

In FIG. 1, the washer feeding apparatus 30 has an upper mounting bracket 80 which is securely attached to the pneumatic fastener driver 32 by an upper mounting bracket fastener 82. The upper mounting bracket 80 has a magazine slide surface 84 such that the tubular magazine 34 can slide along its axis 64 with reference to the pneumatic fastener driver 32, carrying with it the channel housing 36 connected to the contact safety mechanism linkage 54 of the fastener driver 32. The magazine slide surface 84 is sized and shaped such that the magazine 34 is free to move to allow for free operation of the contact safety mechanism linkage 54, while at the same time providing a radial bearing surface such that the tubular magazine 34 is constrained against lateral or skewing motion with reference to the nail gun 32.

To compensate for any drag on the contact safety mechanism 54 induced by the magazine slide surface 84, a contact safety assist spring 86 is compressed between the upper mounting bracket 80 and a spring stop ring 88 on the tubular magazine 34. The contact safety assist spring 86 accordingly urges the assembly of the tubular magazine 34 and channel housing 36, and thus the contact safety mechanism 54, downwardly (in the orientation of FIG. 1).

Referring to FIG. 3, the alternative washer feeding apparatus 70 differs from the apparatus 30 of FIG. 1 in that, in FIG. 3, the tubular magazine 34 and the channel housing 36 are rigidly fixed to the fastener driver 32. In that event, the contact safety mechanism 54 of the fastener driver 32 is fitted with a suitable foot (not shown) which can move relative to and is shaped to clear the washer feeding apparatus 70. In FIG. 3, an upper mounting bracket 90 is attached to the tubular magazine 34 in a fixed yet adjustable manner, employing a clamp or set screws (not shown). The channel housing 36 in FIG. 3 is filled with a sleeve 92 that receives the exit barrel 42 of the fastener driver 32. The exit barrel 42 is secured to the channel housing 36 by a set screw 94 received in a threaded bore 96.

In both the washer feeding apparatus embodiments 30 and 70 of FIGS. 1 and 3, at the upper end 62 of the tubular magazine 34 is a magazine lid housing 98, which is securely affixed to the tubular magazine 34. The magazine lid housing 98 is described in greater detail hereinbelow with reference to FIGS. 18–22. The magazine lid housing 98 is mounted at approximately the height of the host pneumatic fastener driver 32.

Figure 4:
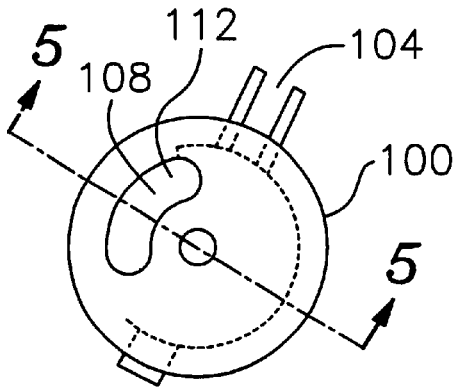
FIG. 4 is a top plan view of an exhaust collection manifold housing of the washer feeding apparatus of FIGS. 1 and 2.
Figure 5:
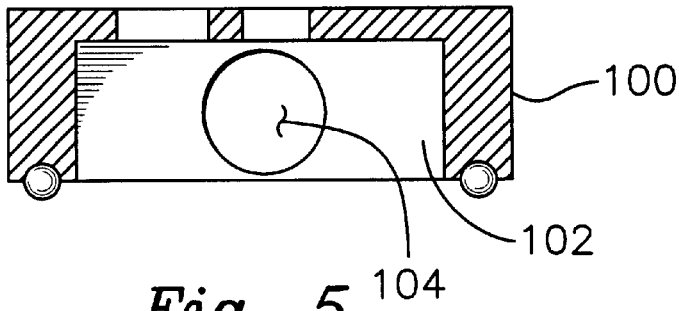
FIG. 5 is a cross section taken on line 5—5 of FIG. 4.
Figure 6:
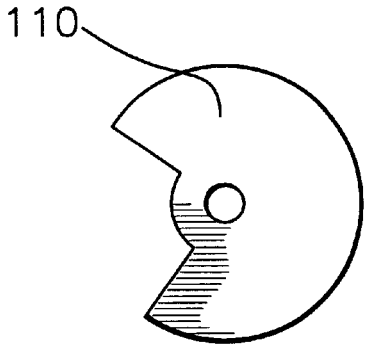
FIG. 6 is a top view of an adjustment plate contained within the exhaust collection manifold housing of FIGS. 4 and 5.
Figure 7:
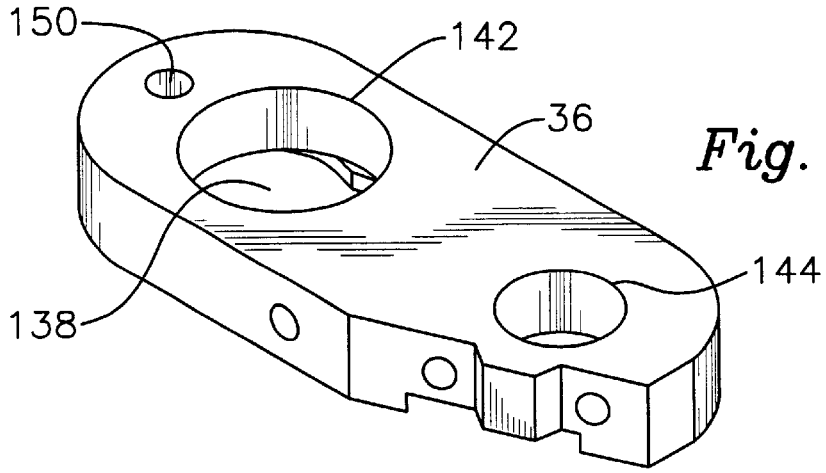
FIG. 7 is a three dimensional view of the channel housing of FIG. 2 in isolation, with the bottom cover plate removed.
Figure 8:
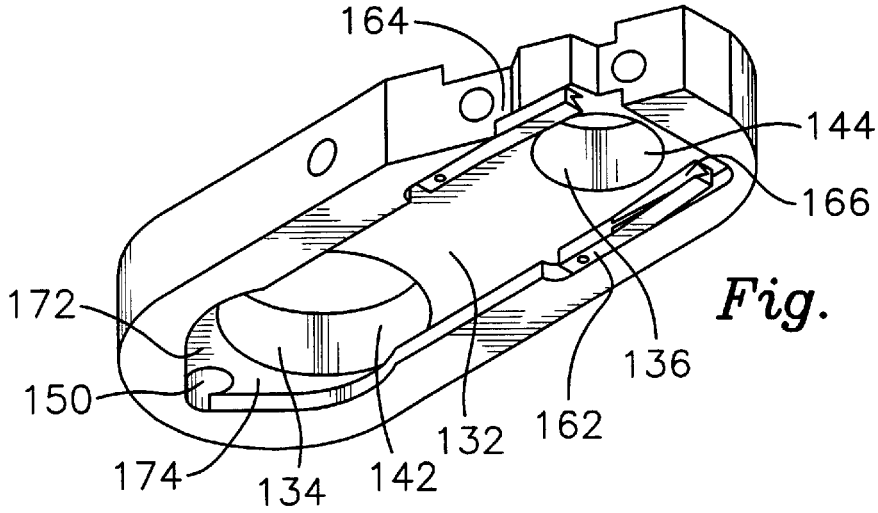
FIG. 8 is a three dimensional underside view of the channel housing of FIG. 2 in isolation, with the bottom cover plate removed.
Figure 9:
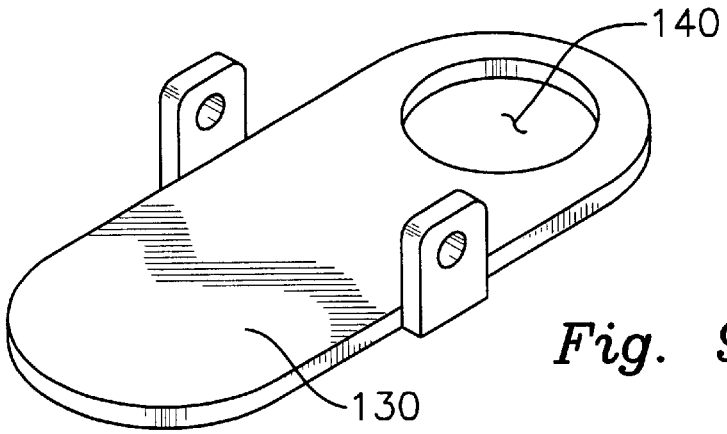
FIG. 9 is a three dimensional view of the bottom cover plate of the FIG. 2 channel housing in isolation.

With reference to FIGS. 4–6, in addition to FIGS. 1 and 3, the exhaust collection system 58 includes an exhaust collection housing 100 defining a plenum 102 positioned over the exhaust gas ports 56. The plenum 102 is connected via a port 104 to a gas pressure supply conduit 106 which supplies pressurized gas for operation of the washer feeding apparatus 30 or 70. As a typical pneumatically operated nail gun generates a volume of exhaust gas well in excess of what is required for operation of the washer feeding apparatus 30 or 70, a gas escape port 108 is provided in the exhaust collection housing 100, the degree of opening of which is controlled by rotation of an adjustment plate 110 having an arcuate gap 112 which permits the effective area of the gas escape port 108 to be varied as required. The exhaust collection housing 100 is secured by a machine screw 114, as is best seen in FIGS. 1 and 3.

Different exhaust collection systems 58 may be required for different models of pneumatically operated fastener drivers made by various manufacturers. Some commercially available pneumatic fastener drivers are manufactured with a plugged port containing an exhaust pressure supply, and this can be directly accessed without altering the exhaust manifold of the pneumatic fastener driver 32. Other available fastener drivers require some modification of the exhaust manifold.

In the illustrated embodiments, the exhaust collection housing 100 is interfaced with the exhaust gas ports 56 by replacing the original exhaust manifold (not shown) of the pneumatic fastener driver 32 with the exhaust collection housing 100. The machine screw 114 is thus an existing part of the fastener driver 32 associated with the original exhaust manifold (not shown).

The gas pressure supply conduit 106 branches into a magazine gas pressure supply conduit 120 connected to the upper end 62 of the tubular magazine 34 for urging washers 38 contained within the magazine 34 towards the lower, exit end 60; and into a delivery channel gas pressure supply conduit 122 connected generally to the channel housing 36 for propelling washers 38 as described in greater detail hereinbelow. Also provided and illustrated in highly schematic fashion is an exhaust gas pressure supply shutoff or diverter 124 which allows the pneumatically operated fastener driver 32 to be used for simply driving nails, without operation of the washer feeding apparatus 30 or 70.

Referring now to FIGS. 7–10, in addition to FIGS. 1–3, defined within the channel housing 36 and an associated bottom cover plate 130 is a washer delivery channel 132. At one end of the washer delivery channel 132 is an acceleration chamber 134 which receives washers 38 one at a time from the magazine 34. At the other end of the delivery channel 132 is a retention region 136 to which washers 38 are pneumatically driven. Washers 38 enter the acceleration chamber 134 from the exit end 60 of the tubular magazine 34, which is pressed into a magazine receiving aperture 138 within the channel housing 36, just above the acceleration chamber 134. Washers eventually exit the retention region 135 via an exit aperture 140, formed in the bottom cover plate 130. The retention region 136 is arranged such that a washer 38 retained therein is in alignment with the exit barrel 42 of the fastener driver 32, as well as in alignment with the exit aperture 140.

In the top of the channel housing 36 are two apertures 142 and 144. The aperture 142 receives the lower end 60 of the tubular magazine 34, which may be pressed in, welded, or screwed by means of threads (not shown). The other aperture 144 is lined with a hardened metal sleeve 146 which slidably engages the exit barrel 42 of the fastener driver 32 for relative movement of the exit barrel 42 with reference to the channel housing 36 which, in the FIG. 1 embodiment, is connected to the contact safety mechanism 54.

The channel housing 36 has a gas supply port 150 connected to a supply of pressurized gas, in particular to the delivery channel gas pressure supply conduit 122. The gas supply port 150 delivers pressurized gas to a gas channel 152 adjacent the acceleration chamber 134. This supply of pressurized gas propels washers 38 from the acceleration chamber 134 to the retention region 136 for subsequent engagement by fasteners, such as the representative fastener 40, driven by the fastener driver 32 and exiting from the retention region 136 through the exit aperture 140. A barrier pin 154, which as a matter of convenience in construction, is integral with and depends from the lower end 60 of the tubular magazine 34, keeps washers 38 out of the gas channel 152.

Within the retention region 136 at the end of the washer delivery channel 132 opposite the gas channel 152 and the acceleration chamber 134 is a stop 156 for preventing further travel of a washer 38 once pneumatically propelled to the retention region 136. The stop 156 stops each washer 38 in correct alignment for proper placement of a fastener as it exits the fastener exit barrel 42. The stop 156 may be of any size, shape or mechanism so as to allow for proper alignment of washers within the retention region 136. Excessive rebound can be prevented in a variety of ways, including the use of a restrictor.

Figure 11:
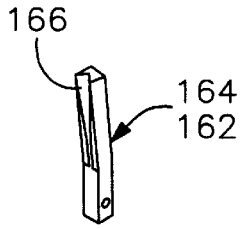
FIG. 11 is a three dimensional view of a restrictor spring in isolation.
Figure 12:
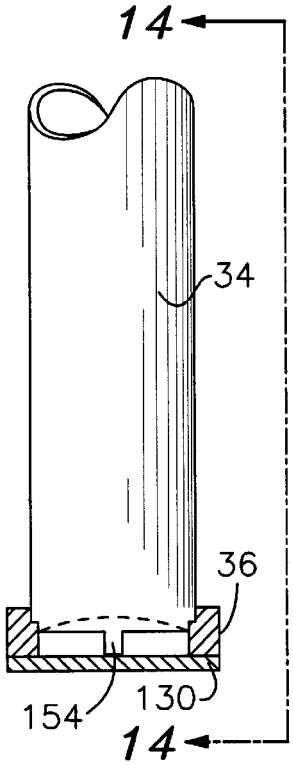
FIG. 12 is a partially sectioned view, taken generally on line 12—12 of FIG. 1 or FIG. 3, of the lower end of the tubular magazine in full, in particular depicting a barrier pin, and a portion of the channel housing in cross section.

Thus, a restrictor, generally designated 160, is provided. In an illustrated embodiment, the restrictor 160 comprises a pair of restrictor springs 162 and 164, which are shown in isolation in FIG. 11. The illustrated restrictor springs 162 and 164 each have a V-shaped channel 166 for engaging the edge of a washer 38. The restrictor 160 retains a washer 38 within the retention region 136 prior to be engaged by a fastener such as the roofing nail 40, driven by the fastener driver 32. The restrictor 160 in particular prevents a washer 38 from prematurely exiting through the exit aperture 140 by any force, such as gravity, recoil from firing or impact, cycling of air pressure, or any other unintentional force, other than the actual driving of a fastener such as the roofing nail 40 by the fastener driver 32.

As alternatives to the restrictor springs 162 and 164 illustrated, other forms of mechanical retention devices can be employed. In the case of washers made of ferrous metal, the restrictor 160 may comprise a magnet (not shown).

As yet another alternative, the restrictor 160 can comprise simply the elasticity of washers 38 themselves, in the case of plastic washers, in which case the side walls of the retention region 136 are sized to a precise tolerance to effect proper gripping of the washers 38, aided by washer elasticity.

A washer thus retained by the restrictor 160, and in contact with the stop 156, is in alignment with the exit aperture 140. The exit aperture is shaped such that a washer does not pass through due to any incidental forces yet, when the fastener is driven, the washer is ejected without excessive damage to the washer. Thus, the fastener, such as the representative roofing nail 40, is projected through the central aperture in the washer and driven into the work piece while, at the same time, the washer is properly placed in its installed position on the fastener, such as the representative roofing nail 40.

Figure 10:
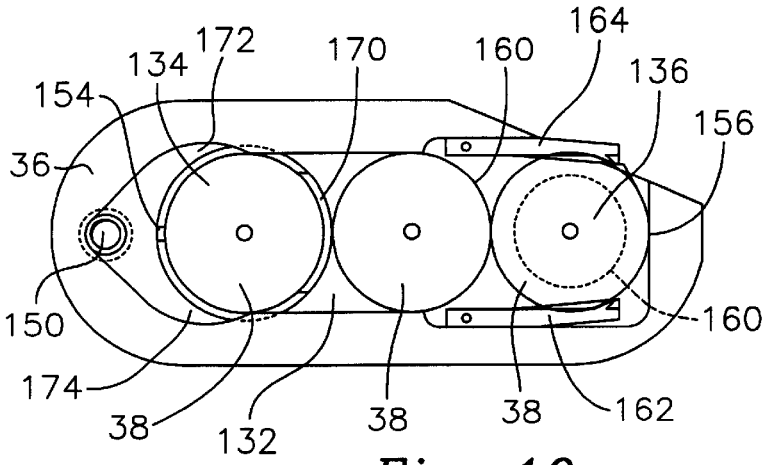
FIG. 10 is a view, taken generally on line 10—10 of FIG. 1 or FIG. 3, showing a plurality of washers within the acceleration chamber, washer delivery channel and retention region of the channel housing.

With reference now to FIGS. 12–15, in addition to FIGS. 1, 3 and 10, the manner in which washers 38 are supplied from the magazine 34 to the acceleration chamber 134 and delivered through the channel 132 for positioning in the retention region 136 is now described in greater detail.

The magazine 34 thus terminates into the acceleration chamber 134, and is securely adhered to the channel housing 36 such that washers 38 contained within the magazine 34 can pass one at a time into the acceleration chamber 134. The washer delivery channel 132 is shaped to allow free passage of washers 38, while restricting washers 38 from overlapping each other or become misaligned. The bottommost washer 38 exits the magazine 34 in such a manner that it fully enters the washer delivery channel 132 before the next washer 38 in the magazine 34 is able to enter the shaped channel 132, regardless of variable factors such as pressure supply, fastening device sequence, or other occurrent forces.

Figure 13:
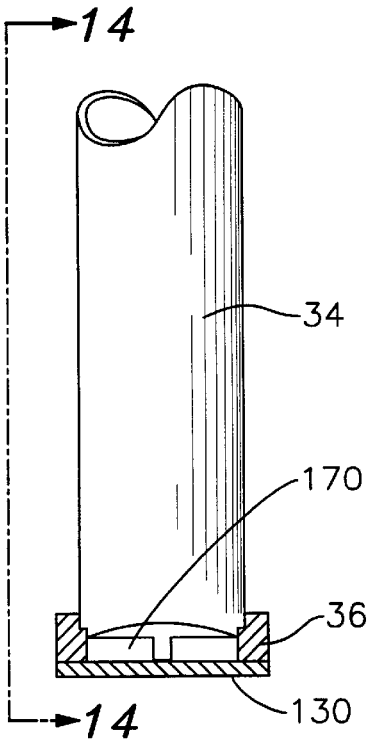
FIG. 13 is a partially sectioned view, taken generally on line 13—13 of FIG. 1 or FIG. 3, of the lower end of the tubular magazine in full, in particular depicting a separation and alignment orifice, and a portion of the channel housing in cross section.
Figure 14:
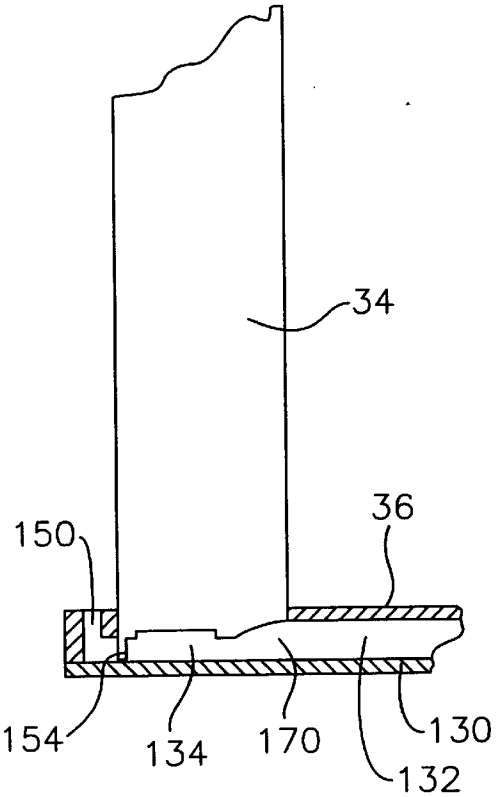
FIG. 14 is a partially sectioned view, taken generally on line 14—14 of FIG. 12 or FIG. 13, of the lower end of the tubular magazine in full, and a portion of the channel housing in cross section.

This operation is aided by a separation and alignment orifice 170 which, like the barrier pin 154, as a matter of convenience in construction, is formed as part of the lower end 60 of the tubular magazine 34, as is best seen in FIGS. 13 and 14. The separation and alignment orifice 170 ensures the separation and alignment of washers 38 as they leave the acceleration chamber 134 and enter the washer delivery channel 132.

Gas pressure supplied via the delivery channel gas pressure supply conduit 122 and the gas supply port 150 is directed into the gas channel 152 and then into the acceleration chamber 134 opposite the separation and alignment orifice 170 such that channel feed pressure propels washers 38 from the acceleration chamber 134 through the separation and alignment orifice 170, along the washer delivery channel 132 to the retention region 136, in alignment with the exit barrel 42. Pressure bypass channels 172 and 174 (FIG.

10) prevent blockage of the channel feed pressure by a subsequent washer entering the acceleration chamber 134 from the magazine 34 such as the washer 176 in FIGS. 1 and 3 that is tipped.

Once a washer 38 is at a point in the acceleration chamber 134 where it is aligned such that it is ready to enter the washer delivery channel 132, it is also in a position such that the pressure difference across the acceleration chamber 134 propels the washer into the washer delivery channel 132 to a point where it reliably reaches its destination, in particular, the retention region 136. The acceleration chamber 134 serves several functions in the exemplary embodiment, and could be employed for additional functions. Thus, the acceleration chamber 134 is primarily an area at which washers 38 are individually aligned for entry into the washer delivery channel 132 such that a pressure difference will propel the washer 38 out of the acceleration chamber 134 into the washer delivery channel 132 with sufficient force.

In the illustrated embodiments employing a tubular magazine 34 and the acceleration chamber 134, there is a tendency for a subsequent washer in the magazine 34, such as the washer 176 in FIGS. 1 and 3, to partially advance into the acceleration chamber 134 before a previous washer, such as washer 178 in FIGS. 1 and 3, which is exiting the acceleration chamber 134 has fully entered the washer delivery channel 132. In order to avoid the use of a retaining device or force to prevent this partial entry, the bypass channels 172 and 174 are provided so that the washer 178 continues to be propelled. Only after the first washer 178 has fully entered the washer delivery channel 132 should a subsequent washer 176 be fully aligned or positioned within the acceleration chamber 134 for its entry into the washer delivery channel 132.

The washer delivery channel 132 extends at least approximately perpendicularly to the driver stroke axis 48. This relationship may vary depending upon the mounting of the channel housing 36 to the fastener driver 32. For example, a pivot mount (not shown) may be employed. This relationship is not critical.

Figure 16:
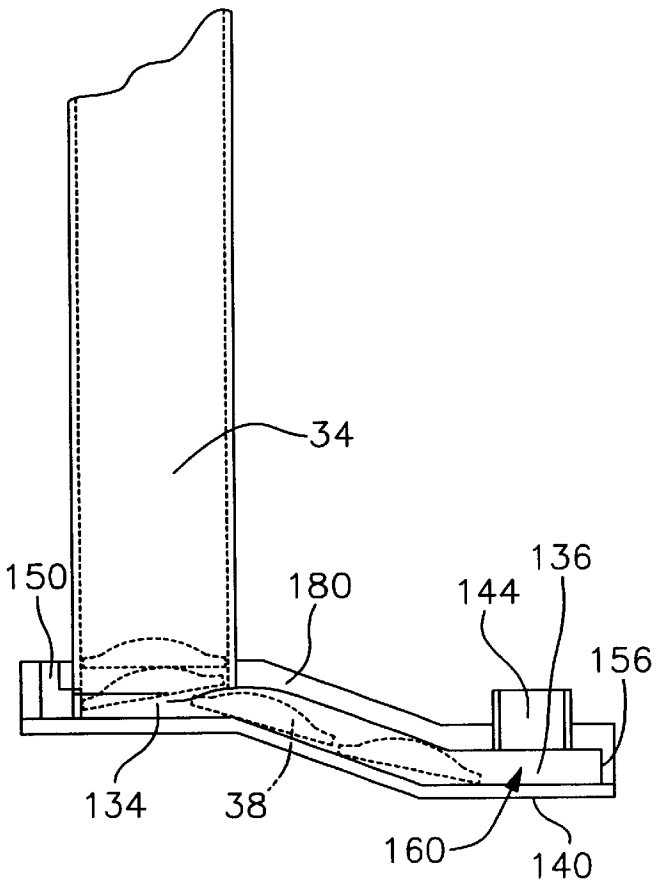
FIG. 16 is a side elevational view showing another embodiment of a channel housing.
Figure 15:
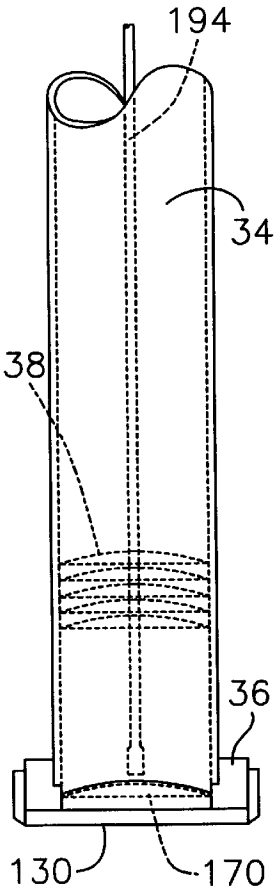
FIG. 15 is a view in the same orientation as FIG. 13 depicting a washer passing through the separation and alignment orifice.

FIG. 16 shows a modified channel housing 180 wherein the washer delivery channel 132 sweeps vertically up from the retention region 136 to the acceleration chamber 134, while still extending approximately perpendicular to the driver stroke axis 48. This modification reduces the contact area of the channel housing 180 on the work surface (not shown).

The washer delivery channel 132 need not be linear so long as its shape allows for proper washer 38 flow. A washer 38 in an intermediate position within the washer delivery channel 132, whether in motion or at rest, can therefore be at any point within the channel 132 between the acceleration chamber 134 and the retention region 136. Although generally not necessary, stops or catches (not shown) may be provided within the washer delivery channel 132 to position or regulate the flow or backflow of washers 38.

Thus any washer 38 occupying space in any portion of the acceleration chamber 134, separation and alignment orifice 170 or channel 132 at any time does not cause the interruption or restriction of proper cycling of any washer 38 in the magazine 34 or channel 132. Once a washer 38 has entered the channel 132 through the orifice 170 from the acceleration chamber 138, it is capable of coming to rest in one or more positions. Accordingly, in the illustrated embodiment, during normal operation there are a plurality of washers within the washer delivery channel, in edge to edge contact. All channels are designed to prevent any misalignment of washers with respect to their prospective destinations or each other.

The channel 132 can be as long or as short as desired. Since no position of a washer 38 at the acceleration chamber 134 end of channel 132 interrupts the cycle, the channel 132 can be of any length or relation to washer diameter.

Exhausting of excess pressure is accomplished in retention region 136 in a manner such that the washer is not forced past restrictors 160 through exit aperture 140 by remaining pressure from preceding cycle, leading pressure from the following cycle, or full pressure from cycle in the fastener or fastening device's drive pin does not contact and cause exit of washer in barrel chamber.

The washer feeding apparatus 30 and 70 thus can operate with a continuous gas pressure supply. As a washer 38 exits the retention region 136 upon operation of the hammer 44 of the fastener driver 32, subsequent washers 38 in the delivery channel 132 move forward. When the acceleration chamber 134 is clear, a washer 38 enters from the magazine 34. The restrictor 160 prevents washers 38 from prematurely exiting the retention region 136.

The washer feeding apparatus 30 and 70 also operate when supplied with periodic gas pressure pulses. Thus, with each cycle of the fastener driver 32, exhaust gas through the exhaust gas port 56 is collected by the exhaust collection system 58, and is used to generally advance washers 38 and, in particular, to deliver another washer 38 into position within the retention region 136.

In an embodiment where the channel 132 is such that there is space for one or more washers 38 or portions of washers 38 in the channel 132, the system is capable of working with washers 38 occupying any and all positions either simultaneously or in any combination. A washer 38 also is capable of traveling from the acceleration chamber 134 through orifice 170 and channel 132 past any restrictions or retainers to a position properly aligned in the retention region 136 in one cycle of pressure difference; this allows for continuous cycle of washers 38 regardless of number of washers 38 greater than zero in or remaining in magazine 34, acceleration chamber 134, channel 132, or retention region 136.

Another result is that, as long as a washer 38 is in the retention region 136 at loading or in the acceleration chamber 134, no fastener/washer cycle will be missed and, if run dry, only one cycle of pressure is required to fully load from acceleration chamber 134 to retention region 136. In the case of synchronized or combined pressure supply to magazine feed, a washer or several washers can flow from any point in the magazine 34 through the acceleration chamber 134 and channel 132 into the retention region 136 in one pressure cycle if of adequate pressure and duration.

Figure 17:
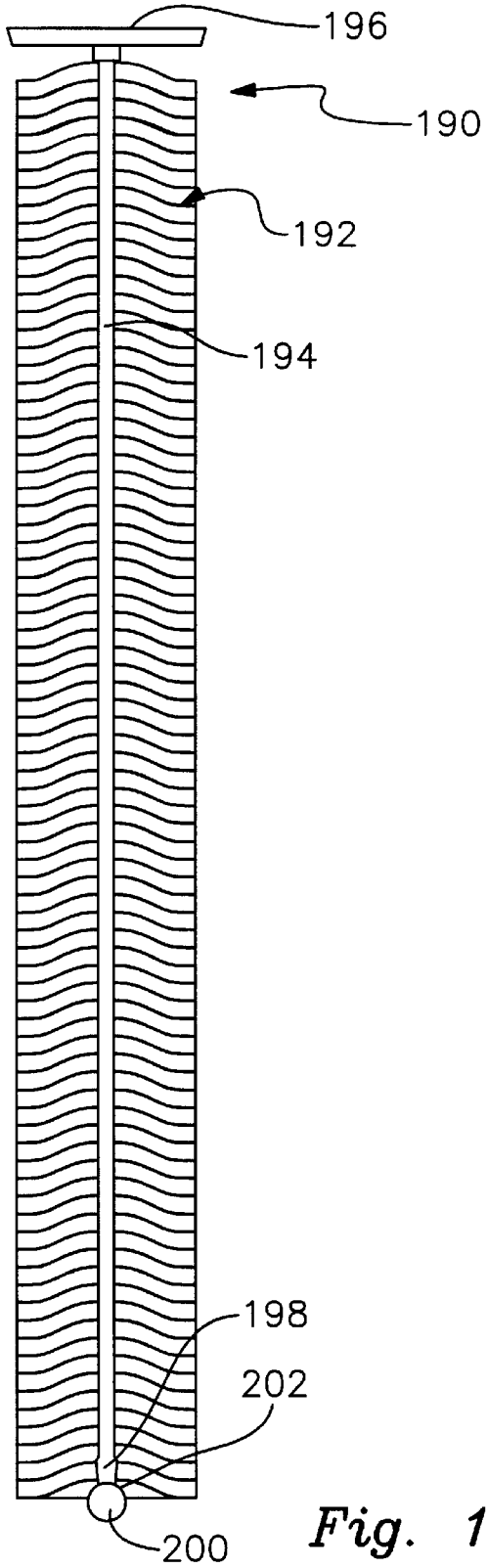
FIG. 17 is a view, partly in section, of a plurality of washers retained on a skewer prior to loading into the tubular magazine of FIGS. 1, 2 and 3.
Figure 18:
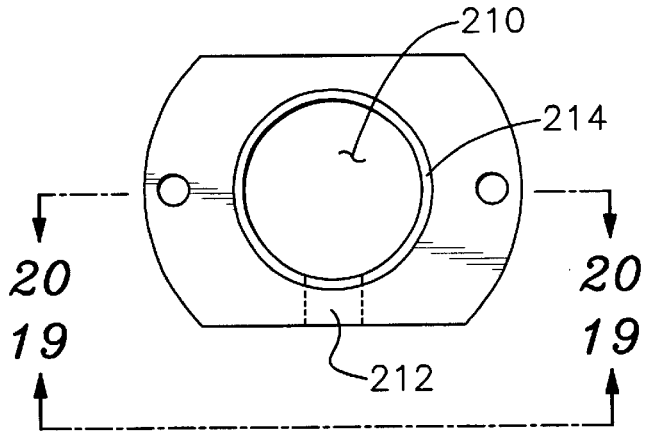
FIG. 18 is a top plan view of the magazine lid housing.
Figure 19:
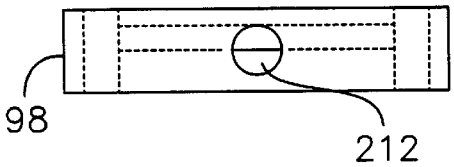
FIG. 19 is a side elevational view taken on line 19—19 of FIG. 18.
Figure 20:
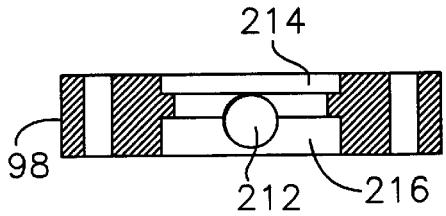
FIG. 20 is a cross sectional view taken on line 20—20 of FIG. 18.
Figure 21:
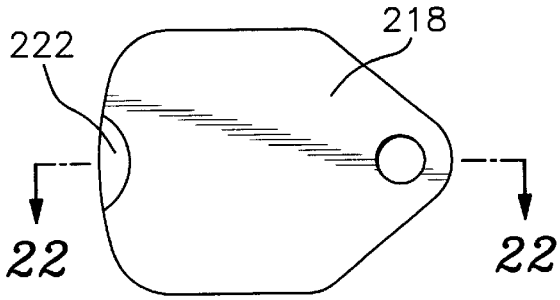
FIG. 21 is a top plan view of the magazine lid.
Figure 22:
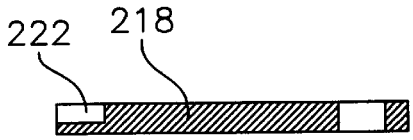
FIG. 22 is a cross section taken on line 22—22 of FIG. 21.

FIG. 17 illustrates a washer skewer assembly 190 supporting a stack 192 of washers prior to being loaded into the tubular magazine 34. Thus, a skewer 194 at its upper or handle end has an attached disk 196, which serves dual purposes of a handle for manual manipulation, and as a retention device when the washer skewer assembly 190 is mounted within the tubular magazine 34. At the free end 198 of the skewer 194 is a removable retention ring 200, which passes through a transverse aperture 202 at the free end 198. The removable retention ring 200 is for shipping purposes. In addition, the free end 198 is split slightly wider so as to retain washers 38 on the skewer 194 after removal of the retention ring 200 as the washer skewer assembly 190 is inserted into the magazine 34.

Accordingly, the stack 192 of washers is mounted on the skewer for convenient transportation and storage in a space efficient manner. The diameter of the skewer 194 is less than the diameter of the central aperture in the washer such that washers can freely move along the skewer 194.

Typically, there are approximately fifteen washers per inch of stack. A typical skewer 194 or stack height is eleven inches, giving the skewer assembly 190 and thus the tubular magazine 34 a capacity of approximately one hundred sixty five washers.

With reference to FIGS. 18–22, the magazine lid housing 98 has a central opening 210 defining a small chamber, into which pressurized gas is directed from the magazine gas pressure supply conduit 120 via a port 212. At the upper end of the central opening 210 is a recess 214 for receiving the skewer disk 196. At the lower end of the central opening 210 is a recess 216 for receiving the upper end 62 of the tubular magazine 34. A lid 218 is secured over the lid housing 98 by means of a screw 220, and pivots sideways to allow access to the interior of the magazine 34. For securing the lid 218 in position, there is a lid latch recess 222 which is engaged by a lid latch 224 (FIGS. 1 and 3), urged into position by a lid latch spring 226.

When the washer skewer assembly 190 is mounted within the magazine 34, and the disk 196 at the top of the skewer 194 captured within the recess 214 and retained by the lid 218 itself, the free end 198 of the skewer 194 is positioned just above the acceleration chamber 134, allowing washers to freely enter the acceleration chamber 134.

Embodiments of one class of plastic washer feeding and positioning devices contain absolutely no moving components, with all necessary functions being accomplished either by specific shaping of all pressure supplies, magazines, acceleration/pressure chambers, restrictors, barrels, exhausts, etc., or by use of elastic and spring-like property of washers themselves, or in conjunction with each other and/or the pressure differences and material surfaces they contact or come to rest upon. In some embodiments a single continuous static passage which functions as all described pressure supplies, magazines, acceleration chambers, separation/orientation orifices, channels, barrel chambers, restrictors, barrels, exhausts, etc. Many other assembly/disassembly, collating, orienting, etc., procedures could also be added by same or other methods at any point prior to, during, or following this class of embodiments.

While specific embodiments of the invention have been illustrated and described herein, it is realized that numerous modifications and changes will occur to those skilled in the art. It is therefore to be understood that the appended claims are intended to cover all such modifications and changes as fall within the true spirit and scope of the invention.

What is claimed is:

1. Washer feeding apparatus for a fastener driver having a driver stroke axis and an exit barrel, said apparatus comprising:

a magazine for holding a plurality of washers;

a delivery channel having an acceleration chamber at one end for receiving washers one at a time from said magazine, and a retention region at the other end to which washers are pneumatically driven, said retention chamber having an exit aperture aligned with the exit barrel and arranged such that a washer retained therein is in alignment with the fastener driver exit barrel and with said exit aperture; and a supply of pressurized gas for propelling washers by gas contact from said acceleration chamber to said retention region for subsequent engagement by fasteners driven by the fastener driver and exiting from said retention region through said exit aperture.

2. The washer feeding apparatus of claim 1, wherein said supply of pressurized gas supplies pressurized gas in periodic pulses synchronized with operation of the fastener driver.

3. The washer feeding apparatus of claim 2, wherein said supply of pressurized gas comprises a connection to an exhaust gas port of the fastener driver.

4. The washer feeding apparatus of claim 1, which has no moving parts for transporting washers through said delivery channel.

5. The washer feeding apparatus of claim 1, wherein a plurality of washers may at one time be contained within said delivery channel and retention region.

6. The washer feeding apparatus of claim 1, wherein said delivery channel extends at least approximately perpendicularly to the driver stroke axis.

7. The washer feeding apparatus of claim 1, which further comprises a stop within said retention region for preventing further travel of a washer once pneumatically propelled to said retention region.

8. The washer feeding apparatus of claim 1, which further comprises a restrictor for retaining a washer within said retention region prior to being engaged by a fastener driven by the fastener driver.

9. The washer feeding apparatus of claim 8, wherein said restrictor comprises a spring.

10. The washer feeding apparatus of claim 1, wherein said magazine comprises a tube having a filling end and an exit end and within which washers are stacked, and wherein washers enter said acceleration chamber one at a time from said exit end.

11. The washer feeding apparatus of claim 10, wherein said tube has an axis which is at least approximately parallel to the driver stroke axis.

12. The washer feeding apparatus of claim 11, wherein said delivery channel extends at least approximately perpendicularly to the driver stroke axis and to said tube axis.

13. The washer feeding apparatus of claim 10, which further comprises a supply of pressurized gas connected to said filling end for urging washers within said tube towards said exit end.

14. The washer feeding apparatus of claim 10, which further comprises a lid over said filling end.

15. The washer feeding apparatus of claim 10, wherein said tube has a central axis, and which apparatus further comprises a skewer extending along said tube central axis and passing through apertures in the washers, said skewer having a fixed end secured to said filling end and a free end terminating adjacent to said exit end.

16. The washer feeding apparatus of claim 10, wherein said acceleration chamber and said delivery channel are shaped such that a subsequent washer cannot fully enter said acceleration chamber until an immediately prior washer has fully entered said delivery channel.

17. The washer feeding apparatus of claim 1, wherein said acceleration chamber and said delivery channel are shaped such that a subsequent washer cannot fully enter said acceleration chamber until an immediately prior washer has fully entered said delivery channel.

* * * * *